US011286954B1

(12) United States Patent
Jia

(10) Patent No.: US 11,286,954 B1
(45) Date of Patent: Mar. 29, 2022

(54) AIR DUCT ASSEMBLY FOR AXIAL FLOW FAN

(71) Applicants: GD MIDEA ENVIRONMENT APPLIANCES MFG CO., LTD., Guangdong (CN); MIDEA GROUP CO., LTD., Guangdong (CN)

(72) Inventor: Xintao Jia, Zhongshan (CN)

( * ) Notice: Subject to any disclaimer, the term of this patent is extended or adjusted under 35 U.S.C. 154(b) by 147 days.

(21) Appl. No.: 16/960,547

(22) PCT Filed: Jun. 28, 2018

(86) PCT No.: PCT/CN2018/093271
§ 371 (c)(1),
(2) Date: Oct. 26, 2020

(87) PCT Pub. No.: WO2019/136940
PCT Pub. Date: Jul. 18, 2019

(30) Foreign Application Priority Data

Jan. 13, 2018 (CN) ..... 201820054202.8

(51) Int. Cl.
*F04D 29/54* (2006.01)
*F04D 29/32* (2006.01)

(52) U.S. Cl.
CPC ..... *F04D 29/545* (2013.01); *F04D 29/325* (2013.01)

(58) Field of Classification Search
None
See application file for complete search history.

(56) References Cited

U.S. PATENT DOCUMENTS 5,445,215 A * 8/1995 Herbert ..... F04D 27/009 165/80.3
6,082,969 A * 7/2000 Carroll ..... F04D 29/326 416/169 A
2007/0077139 A1* 4/2007 Baugh ..... F04D 29/281 415/119
2009/0162210 A1* 6/2009 Hwang ..... F04D 29/281 416/96 R
2011/0280719 A1* 11/2011 Farlow ..... F04D 29/526 415/208.1

FOREIGN PATENT DOCUMENTS

CN 2466403 Y 12/2001
CN 201255142 Y 6/2009
CN 102588338 A 7/2012
CN 102588339 A * 7/2012 ..... F04D 29/384
CN 202579307 U * 12/2012
CN 104595209 A 5/2015
JP 4829556 B2 12/2011

OTHER PUBLICATIONS

International Search Report in PCT/CN2018/093271.

* cited by examiner

*Primary Examiner* — Michael Lebentritt
(74) *Attorney, Agent, or Firm* — Kilpatrick Townsend & Stockton, LLP

(57) ABSTRACT

An air duct assembly for an axial flow fan including an air inlet shroud and an air outlet shroud. The air inlet shroud includes a plurality of mutually angled air inlet surfaces, and a ratio of an area of the air inlet surfaces of the air inlet shroud to that of air outlet surfaces of the air outlet shroud is 1.1 to 1.35. The air inlet shroud is provided to have mutually angled air inlet surfaces to increase the ratio of the area of the air inlet surfaces of the air inlet shroud to that of the air outlet surfaces of the air outlet shroud, obtaining a higher wind speed with fairly little noise.

14 Claims, 3 Drawing Sheets

AIR DUCT ASSEMBLY FOR AXIAL FLOW FAN

CROSS-REFERENCES TO RELATED APPLICATIONS

The present disclosure is a national phase application of International Application No. PCT/CN2018/093271, filed on Jun. 28, 2018, which claims the priority of Chinese Application No. 201820054202.8, filed in the Chinese Patent Office on Jan. 13, 2018, the entireties of which are herein incorporated by reference.

FIELD

The present disclosure relates to an air duct assembly for an axial flow fan.

BACKGROUND

In most cases, the air volume and wind speed of heater products in the prior art have been compromised to achieve a noise level of less than 50 dB(A), resulting in insufficient wind speed and air volume of the products across the whole heater industry, which leads to poor customer experience in that the hot wind is barely felt one meter away. Means to increase wind speed in the prior art include decreasing the air outlet surface and increasing the air inlet surface. However, whether it is to decrease the air outlet surface or increase the air inlet surface, other structures of the product will need to be adjusted. In addition, decrease in the air outlet surface will also negatively affect the user experience.

SUMMARY

Embodiments of the disclosure provide an air duct assembly for an axial flow fan to solve the problem of low wind speed at the air outlet existing in the prior art.

Embodiments of the present disclosure provides an air duct assembly for an axial flow fan, including an air inlet shroud and an air outlet shroud, the air inlet shroud includes a plurality of mutually angled air inlet surfaces, and a ratio of an area of the air inlet surfaces of the air inlet shroud to that of air outlet surfaces of the air outlet shroud is 1.1 to 1.35.

In one embodiment, the ratio of an area of the air inlet surfaces of the air inlet shroud to that of the air outlet surfaces of the air outlet shroud is 1.25.

In one embodiment, the air inlet shroud includes a first air inlet surface, a second air inlet surface and a third air inlet surface which are mutually angled each other.

In one embodiment, the air duct assembly for the axial flow fan further includes a guide duct inside which fan blades are installed.

In one embodiment, an end of the guide duct is fixed to the air outlet shroud.

In one embodiment, the guide duct has a tapered cross-sectional area along the wind direction.

In one embodiment, a diversion section is formed on an end of a windward edge of each of the fan blades proximal to a blade tip, and a plurality of diversion grooves are disposed on the diversion section; a distance between the closest point of the diversion section and the center of rotation of the fan blade is r1, a distance between the farthest point of the diversion section and the center of rotation of the fan blade is r2, and a distance between the farthest point on the windward edge and the center of rotation of the fan blade is r, and the ratio of (r2−r1) to r is 1/3 to 1/2, and each of the diversion groove has a tapered depth toward the center of rotation.

In one embodiment, a grille of the air outlet shroud includes a plurality of grid bars.

In one embodiment, all of the grid bars are distributed along the circumference, and at least an outer section of each grid bar gradually inclines toward the rotation direction of the fan blade in a direction away from the center of the circumference.

In one embodiment, when the air duct assembly for an axial flow fan includes the guide duct, the guide duct is projected on the grille along its own axial direction to obtain a first projection line, the first projection line and the grid bars intersect at a first point, an included angle between a first tangent of the grid bar at the first point and a second tangent of the first projection line at the first point is 100° to 115°.

In one embodiment, an included angle between the first tangent and the second tangent is 105°.

In one embodiment, each of the grid bar has gradually increased cross-sectional area along the air outlet direction, so that an air outlet area between adjacent grid bars gradually decreases along the air outlet direction.

In one embodiment, the grid bars are streamlined along the air outlet direction.

In one embodiment, the grid bars have the number of odd.

Embodiments of the present disclosure have the following aspects: the air duct assembly for an axial flow fan of the present disclosure increases the ratio of the area of the air inlet surfaces of the air inlet shroud to that of the air outlet surfaces of the air outlet shroud without changing other structures of the heater by providing the air inlet shroud with the plurality of mutually angled air inlet surfaces so that a higher wind speed is obtained at the air outlet surfaces. Moreover, by configuring the ratio of the area of the air inlet surfaces of the air inlet shroud to that of the air outlet surfaces of the air outlet shroud to be 1.1 to 1.35, the heater is allowed to obtain a higher wind speed with fairly little noise.

BRIEF DESCRIPTION OF THE DRAWINGS

The embodiments of the present disclosure will be shown in the drawings briefly introduced as follows.

REFERENCE NUMBERS

Figure 1:
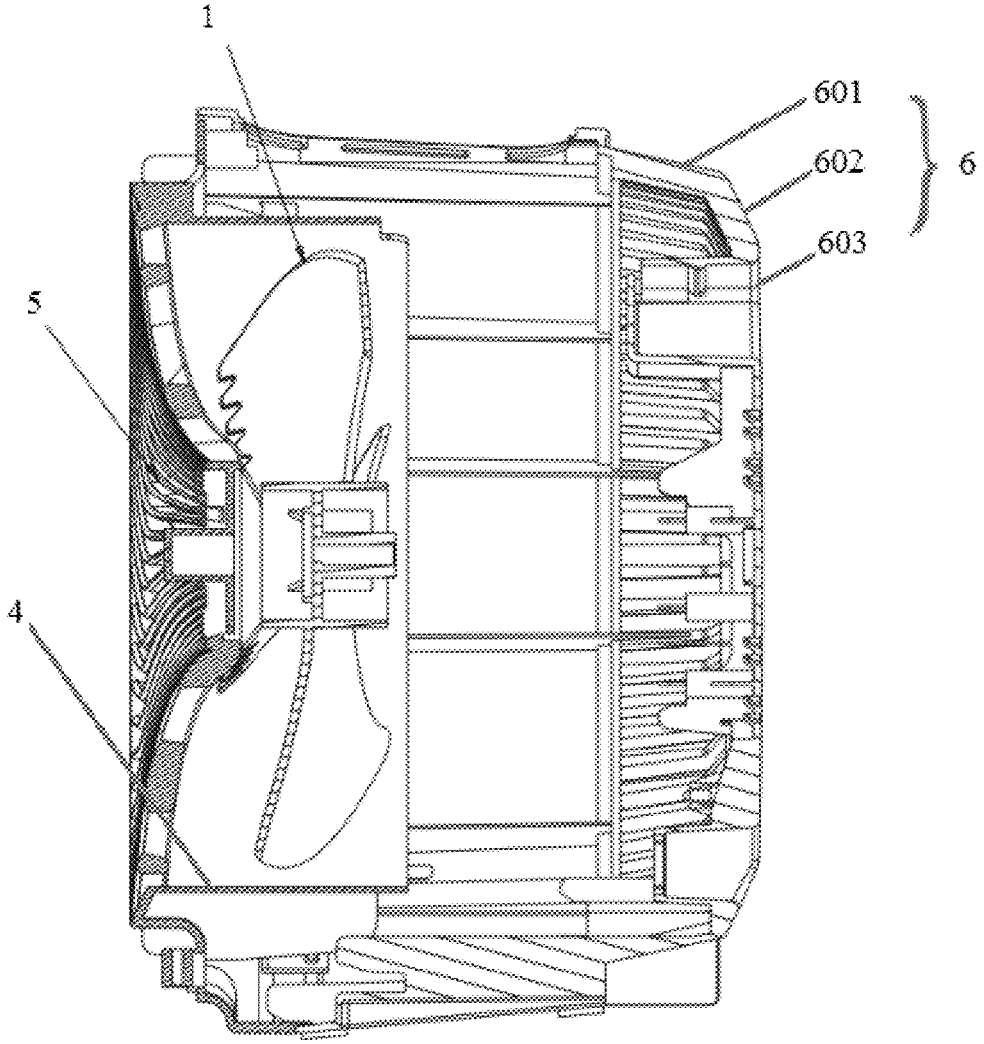
FIG. 1 is a structural diagram of an air duct assembly for an axial flow fan in an embodiment.

1 fan blade
2 diversion groove
3 hub
4 air duct
5 air outlet shroud
6 air inlet shroud
601 first air inlet surface
602 second air inlet surface
603 third air inlet surface
7 grille
8 first projection line

DETAILED DESCRIPTION OF THE DISCLOSURE

Embodiments of the present disclosure are more clearly understood by the detailed description of the present disclosure will be described in further detail below in conjunction with the accompanying drawings and embodiments. It should be noted that the embodiments of the present disclosure and the features in the embodiments can be combined with each other without conflicts.

With respect to the description of the present disclosure, it should be noted that the orientation or positional relationship indicated by the terms such as "center", "longitudinal", "lateral", "upper", "lower", "front", "back", "left", "right", "vertical", "horizontal", "top", "bottom", "inner", "outer" is based on the orientation or positional relationship shown in the drawings, the purpose of which is only to facilitate describing the present disclosure and simplify the description, rather than to indicate or imply that the device or element referred to must have an orientation, be constructed and operated in an orientation, and therefore cannot be construed as a limitation of the present disclosure. In addition, the terms "first", "second" and "third" are for descriptive purpose only, and cannot be understood as indicating or implying the relative importance.

In the description of the present disclosure, it should be noted that, unless otherwise clearly specified or defined, the terms "connect with" and "connect to" should be understood in a broad sense, for example, it can be a fixed connection or a detachable connection, or an integral connection; it can be mechanically or electrically connected, directly connected or indirectly connected through an intermediary.

Taking only the air duct assembly for an axial flow fan applied to heaters as an example, the disclosure will be further explained hereinafter. Without loss of generality, the air duct assembly for an axial flow fan of the present disclosure can be used not only for heaters, but also for other products with disclosure scenarios close to or the same as the heaters.

As shown in FIG. 1, the air duct assembly for an axial flow fan of the present embodiment includes an air inlet shroud 6 and an air outlet shroud 5. The air inlet shroud 6 includes a plurality of mutually angled air inlet surfaces, and a ratio of an area of the air inlet surfaces of the air inlet shroud 6 to that of air outlet surfaces of the air outlet shroud 5 is 1.1 to 1.35.

The air duct assembly for the axial flow fan of the present embodiment increases the ratio of the area of the air inlet surfaces of the air inlet shroud 6 to that of the air outlet surfaces of the air outlet shroud 5 without changing other structures of the heater by providing the air inlet shroud 6 with the plurality of mutually angled air inlet surfaces so that a higher wind speed is obtained at the air outlet surfaces. Moreover, by configuring the ratio of the area of the air inlet surfaces of the air inlet shroud to that of the air outlet surfaces of the air outlet shroud to be 1.1 to 1.35, and the heater is allowed to obtain a higher wind speed with fairly little noise. In particular, when the ratio of the area of the air inlet surfaces of the air inlet shroud 6 to that of the air outlet surfaces of the air outlet shroud 5 is set to be 1.25, the air duct assembly has great advantages over similar products in the aspects of the noise control, the wind speed and air volume control.

In one embodiment, the area of the air inlet surfaces of the air inlet shroud 6 is a sum of the areas of all air inlet surfaces of the air inlet shroud 6.

Worthy of a special mention is that increasing the ratio of the area of the air inlet surfaces of the air inlet shroud 6 to that of the air outlet surfaces of the air outlet shroud 5 often results in unaesthetic appearance of the heater adopting the air duct assembly for the axial flow fan. However, for the air duct assembly for an axial flow fan in the present embodiment, the ratio of the area of the air inlet surfaces of the air inlet shroud 6 to that of the air outlet surfaces of the air outlet shroud 5 is designed to be 1.1 to 1.35, the air inlet shroud 6 is provided with a plurality of mutually angled air inlet surfaces, which beautifies the heater adopting the air duct assembly for an axial flow fan and thus makes the heater favored by users.

As shown in FIG. 1, the air inlet shroud 6 includes a first air inlet surface 601, a second air inlet surface 602 and a third air inlet surface 603 which are mutually angled each other. In this case, even if the cross-sectional area of the air inlet shroud 6 is smaller than that of the air outlet shroud 5, it can be ensured that the area of the air inlet surfaces of the air inlet shroud 6 is larger than the area of the air outlet surfaces of the air outlet shroud 5.

In one embodiment, in the present embodiment, the number of the inlet surfaces of the air inlet shroud 6 is not limited to three but can also be only one or more than three.

Further, the air duct assembly for the axial flow fan of the present embodiment further includes an guide duct 4 inside which fan blades 1 of the air duct assembly for an axial flow fan are installed. Without doubt, the guide duct 4 is disposed between the air inlet shroud 6 and the air outlet shroud 5 of the air duct assembly for the axial flow fan. By providing the guide duct 4 and installing the fan blades 1 inside the guide duct 4, air turbulences can be prevented and uniform air flows at the air outlet surfaces can be obtained, enhancing the user experience.

In the present embodiment, an end of the guide duct 4 is fixed to the air outlet shroud 5. Therefore, when the air outlet shroud 5 and the air inlet shroud 6 are installed, the guide duct 4 can be used as a protective cover of the fan blades 1 to prevent the fan blades 1 from being hit. In one embodiment, the guide duct 4 and the air outlet shroud 5 are integrally formed, to reduce the difficulty of assembling the entire air duct assembly for the axial flow fan.

In one embodiment, the guide duct 4 has a tapered cross-sectional area along the air outlet direction, so that the airflow is accelerated in the guide duct 4, and a higher wind speed is obtained at the air outlet shroud 5 to further meet the user demand for wind speed and air volume.

Figure 2:
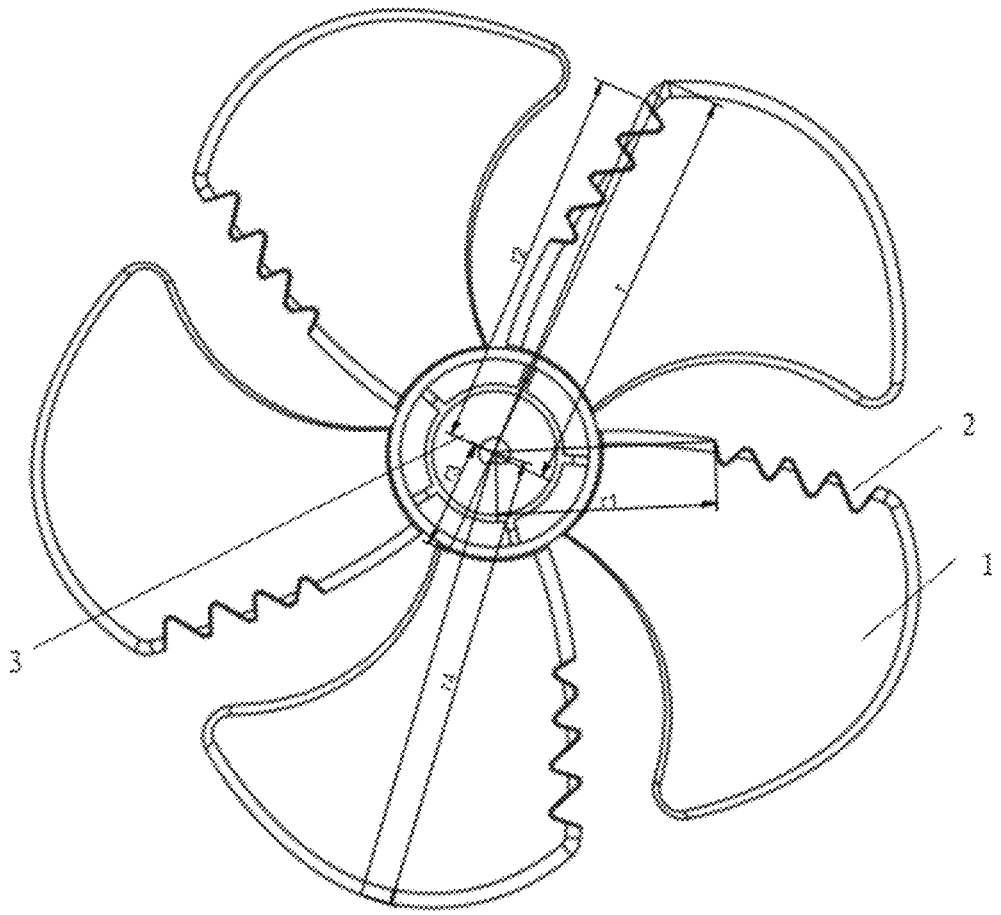
FIG. 2 is a structural diagram of the fan blade in an embodiment.

As shown in FIG. 2, for the air duct assembly for the axial flow fan of the present embodiment, a diversion section is formed on an end of a windward edge of each of the fan blades 1 proximal to a blade tip, and a plurality of diversion grooves 2 are disposed on the diversion section; a distance between the closest point of the diversion section and the center of rotation of the fan blade 1 is $r_1$, a distance between the farthest point of the diversion section and the center of rotation of the fan blade 1 is $r_2$, and a distance between the farthest point on the windward edge and the center of rotation of the fan blade 1 is r, wherein $(r_2-r_1):r=1/3$ to 1/2, and the depth of the diversion groove 2 has a tapered depth toward the center of rotation.

Both the closest point and the farthest point are relative to the center of rotation O. Moreover, the blade tip refers to a portion of the fan blades 1 away from the center of rotation O, while the blade root is a portion of the fan blades 1 close to the center of rotation O.

For the fan blade 1 of the present embodiment, the diversion section thereof can divide an airflow into small airflows at the source of the airflow, to make the diversion grooves 2 on the windward edge achieve the best noise reduction effect. Moreover, the depth of the diversion groove 2 gradually decreases toward the center of rotation, namely, the farther away from the airflow source, the smaller the depth of the diversion groove 2, which ensures a uniform wind speed, making the wind felt by the user more natural. Therefore, the fan blades 1 of the present embodiment can reduce noise without compromising wind speed and air volume, and bring an excellent overall experience to the users.

As shown in FIG. 2, there is a distance between the farthest point of the diversion section and the blade tip, the distance can be adjusted within an interval to facilitate the processing of the diversion section on the basis of ensuring the cutting airflow. Nevertheless, the farthest point of the diversion section can also be designed as against the blade tip.

Through experimental comparison, it has been found that when the diversion section is formed at the end of the fan blades 1 proximal to the blade tip, and the diversion section fulfills $(r_2-r_1):r=1/3$ to $1/2$, it has almost the same noise reduction effect compared with the configuration that the diversion section is formed on the windward edge of the entire fan blades 1.

Moreover, the diversion section is only provided at the end of the fan blade 1 proximal to the blade tip, which can not only achieve almost the same reduction effect as when the diversion section is formed on the entire windward edge, but also avoid the problem that the strength of the fan blade 1 is reduced if the diversion section were formed at the end proximal to the blade root. Once the strength of the fan blade 1 is reduced, the service life of the fan blade 1 not only will be shortened, the noise of the fan blade 1 but also will increase due to the vibration of the fan blades 1 during running.

What is worth mentioning is that, for the diversion section of the present embodiment, the depth of the diversion groove 2 thereon gradually decreases toward the center of rotation, thus, the current fan blades 1 can be further processed to obtain the diversion section without any impact on the strength of the fan blades 1, so that it eliminates the need for an additionally separate design of the fan blades 1.

Besides, when the diversion section is provided at the end of the fan blades 1 proximal to the blade tip, the air resistance to the fan blades 1 can also be reduced, effectively reducing the motor load to increase the wind speed at the same power.

In the present embodiment, it is preferable to make the diversion grooves 2 regularly zigzag shaped, which is not only convenient for being processed, but also has decorative effects when distributed at the blade tip of the fan blade 1. When the diversion grooves 2 are regularly zigzag shaped, all the diversion grooves 2 can be selected to have the same width. In one embodiment, besides the zigzag shape, the diversion grooves 2 may have any other shape as long as it achieves the effect of dividing the airflows.

The fan blades 1 are mounted on a hub 3, assuming that the mounting surfaces of the fan blades 1 and the hub 3 intersect on a first curve, when the included angle between the tangent at any point on the first curve and the vertical surface of the hub 3 is 30±5°, a greater air volume and a higher motor efficiency can be obtained during the running of the air duct assembly for an axial flow fan, so can a lower noise under the same working conditions.

In one embodiment, the mounting surface of the hub 3 refers to a cylindrical surface on the hub 3 for mounting the fan blades 1, and the vertical plane of the hub 3 refers to a plane perpendicular to the central axis of the hub 3.

Further, after the points on the fan blades 1 that are equidistant from the center axis of the hub 3 are connected to form equidistant lines, a second projection line is obtained by projecting the equidistant lines onto the mounting surface of the hub 3 along the radial direction of the hub 3. When the maximum value of the included angle between the tangent at any point on the second projection line and the vertical plane of the hub 3 is 42±5°, the performance of the air duct assembly for an axial flow fan can be further enhanced so that high wind speed, large air volume and low noise are obtained by the air duct assembly for the axial flow fan during running.

In one embodiment, it is preferable but not necessary that the curvature distribution value of the fan blades 1 is 0 to 0.176, by way of which the fan blades 1 obtains the best performance.

In addition, in the present embodiment, the radius of the hub 3 is $r_3$, and the distance between the farthest point on the fan blades 1 and the center of rotation thereof is $r_4$. When the ratio of $r_3$ to $r_4$ is between 0.2 and 0.3, a larger air volume may be obtained without compromising the installation strength of the hub 3 and the fan blades 1.

Figure 3:
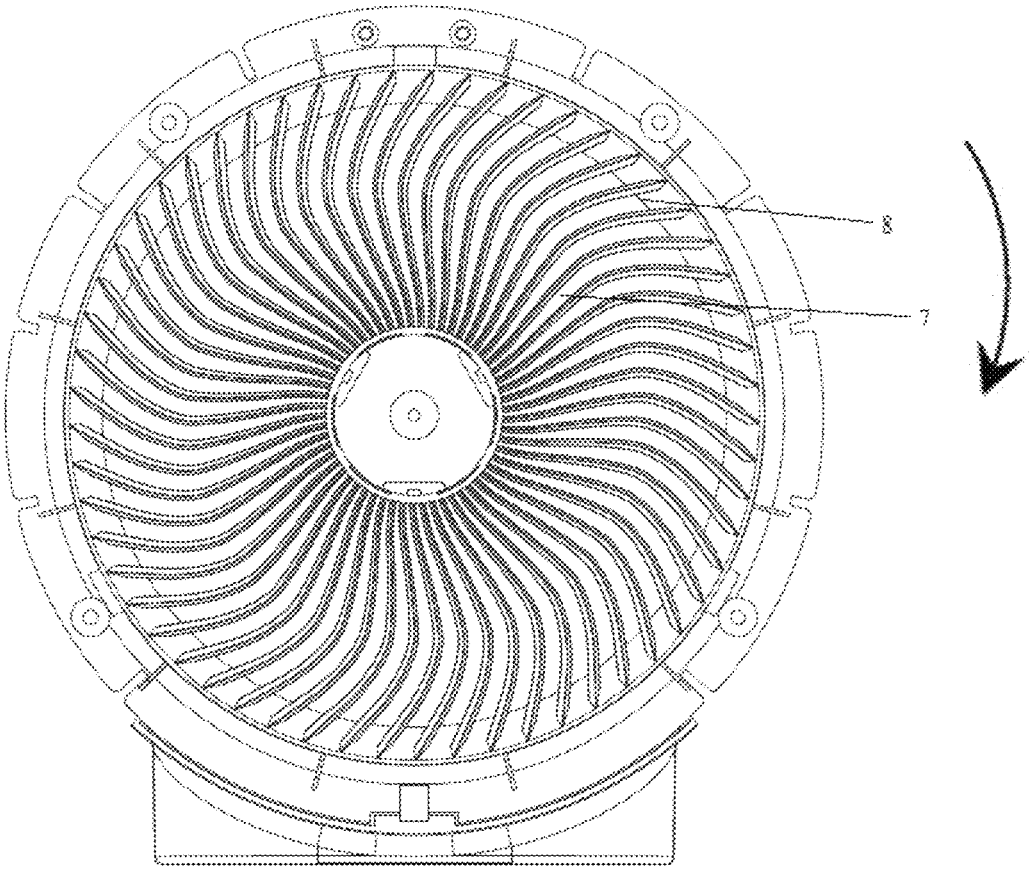
FIG. 3 is an installation diagram of the grid bars in an embodiment.

As shown in FIG. 3, in the present embodiment, a grille 7 of the air outlet shroud includes a plurality of grid bars, and all of the grid bars are distributed along the circumference. In one embodiment, FIG. 3 does not constitute a limitation on the air outlet shroud of the present disclosure, for instance, the grid bars of the air outlet shroud in the present disclosure may also be arranged in cross.

In FIG. 3, an outer section of the grid bar gradually inclines toward the rotation direction of the fan blade in a direction away from the center of the circumference, here, the rotation direction of the fan blade is as indicated by the arrow in FIG. 3. In one embodiment, the "outer section of the grid bar" refers to a section of the grid bar away from the center of the circumference. The grid bars are arranged in this way to ensure that the airflow generated at the fan blade is easier to pass through and thus reduce the wind resistance, to obtain greater wind speed and air volume at the air outlet shroud.

In the direction away from the center of the circumference, the inclination directions of the inner section and the outer section of the grid bar in FIG. 3 are different, the main purpose of which is to obtain a better appearance of the grille 7. In one embodiment, in order to reduce the wind resistance, the entire grid bar can be designed as: the grid bars gradually incline toward the rotation direction of the fan blade in a direction away from the center of the circumference.

Further, when the air duct assembly for the axial flow fan includes a guide duct, the guide duct is projected on the grille 7 along its own axial direction to obtain a first projection line 8, as shown in FIG. 3. The first projection line 8 and the grid bar intersect at a first point, an included angle between a first tangent of the grid bars at the first point and a second tangent of the first projection line at the first point is 100° to 115°. In this case, the resistance of the grille 7 to the airflow can be further reduced to obtain greater wind speed and air volume.

Moreover, it has been found through experiments that when the included angle between the first tangent and the second tangent is 105°, the grille 7 can obtain the best guiding performance.

In order to further improve the air volume and wind speed, each of the grid bar of the air outlet shroud 5 has gradually increased cross-sectional area along the air outlet direction, so that an air outlet area between adjacent grid bars gradually decreases along the air outlet direction. In this case, when the airflows pass through the grille 7, an acceleration pressure is formed on the grille 7 and a higher wind speed is obtained at the air outlet, bringing the user a better experience.

In order to further reduce the wind resistance, the grid bars are streamlined along the air outlet direction and the grid bars of the grille 7 have the number of odd to reduce the noise produced by resonance.

What is claimed is:

1. An air duct assembly for an axial flow fan, comprising: an air inlet shroud and an air outlet shroud; wherein the air inlet shroud comprises a plurality of mutually angled air inlet surfaces, and a ratio of an area of the air inlet surfaces of the air inlet shroud to that of air outlet surfaces of the air outlet shroud is 1.1 to 1.35.

2. The air duct assembly for an axial flow fan of claim 1, wherein the ratio of the area of the air inlet surfaces of the air inlet shroud to that of the air outlet surfaces of the air outlet shroud is 1.25.

3. The air duct assembly for an axial flow fan of claim 1, wherein the air inlet shroud comprises a first air inlet surface, a second air inlet surface and a third air inlet surface which are mutually angled.

4. The air duct assembly for an axial flow fan of claim 1, further comprising a guide duct inside which fan blades are installed.

5. The air duct assembly for an axial flow fan of claim 4, wherein an end of the guide duct is fixed to the air outlet shroud.

6. The air duct assembly for an axial flow fan of claim 4, wherein the air duct has a tapered cross-sectional area along an air outlet direction.

7. The air duct assembly for an axial flow fan of claim 4, wherein a diversion section is formed on an end of a windward edge of the fan blade proximal to a blade tip, and a plurality of diversion grooves are disposed on the diversion section; a distance between a closest point of the diversion section and a center of rotation of the fan blade is $r_1$, a distance between a farthest point of the diversion section and the center of rotation of the fan blade is $r_2$, and a distance between a farthest point on the windward edge and the center of rotation of the fan blade is r, wherein the ratio of $(r_2-r_1)$ to r is 1/3 to 1/2, and each of the diversion groove has a tapered depth toward the center of rotation.

8. The air duct assembly for an axial flow fan of claim 1, wherein a grille of the air outlet shroud comprises a plurality of grid bars.

9. The air duct assembly for an axial flow fan of claim 8, wherein the grid bars are distributed along a circumference, and at least an outer section of each grid bar gradually inclines toward a rotation direction of the fan blade in a direction away from a center of the circumference.

10. The air duct assembly for an axial flow fan of claim 9, wherein when the air duct assembly for the axial flow fan comprises a guide duct, the guide duct is projected on the grille along its own axial direction to obtain a first projection line, the first projection line and the grid bars intersect at a first point, an included angle between a first tangent of the grid bar at the first point and a second tangent of the first projection line at the first point is 100° to 115°.

11. The air duct assembly for an axial flow fan of claim 10, wherein an included angle between the first tangent and the second tangent is 105°.

12. The air duct assembly for an axial flow fan of claim 8, wherein each of the grid bars has gradually increased cross-sectional area along the air outlet direction, so that an air outlet area between adjacent grid bars gradually decreases along the air outlet direction.

13. The air duct assembly for an axial flow fan of claim 12, wherein the grid bars are streamlined along the air outlet direction.

14. The air duct assembly for an axial flow fan of claim 8, wherein the grid bars have a number of odd.

* * * * *